US007850392B2

(12) United States Patent
Schubert

(10) Patent No.: US 7,850,392 B2
(45) Date of Patent: Dec. 14, 2010

(54) PORTABLE ROAD BARRIER UNIT

(76) Inventor: Michael James Schubert, 32 Mira Street, Gepps Cross, South Australia 5034 (AU)

( * ) Notice: Subject to any disclaimer, the term of this patent is extended or adjusted under 35 U.S.C. 154(b) by 179 days.

(21) Appl. No.: 12/200,972

(22) Filed: Aug. 29, 2008

(65) Prior Publication Data

US 2009/0060651 A1 Mar. 5, 2009

(30) Foreign Application Priority Data

Aug. 31, 2007 (AU) ..... 2007907132

(51) Int. Cl.
*E01F 13/00* (2006.01)

(52) U.S. Cl. ..... 404/6

(58) Field of Classification Search ..... 404/6, 404/9

See application file for complete search history.

(56) References Cited

U.S. PATENT DOCUMENTS 1,276,100 A * 8/1918 Niznik ..... 256/1
4,995,756 A * 2/1991 Kilgrow et al. ..... 404/6
5,253,950 A * 10/1993 Kilgrow et al. ..... 404/6
5,536,109 A * 7/1996 Lowndes ..... 404/6
RE35,373 E * 11/1996 Kilgrow et al. ..... 404/6
6,048,128 A * 4/2000 Jones et al. ..... 404/6
2006/0078379 A1 * 4/2006 Kruise ..... 404/6
2008/0124171 A1 * 5/2008 Moormeier et al. ..... 404/6

* cited by examiner

*Primary Examiner*—Raymond W Addie
(74) *Attorney, Agent, or Firm*—Defillo & Associates, Inc; Evelyn A. Defillo

(57) ABSTRACT

The present invention relates an apparatus for deflating at least one tire of a vehicle including, an extendible tire deflating means attached to a housing, a plurality of biasing members adapted to urge the tire deflating means into an extended position, and a retraction means for withdrawing the tire deflating means into a retracted position within said housing, wherein in said retracted position the tire deflating means is held in place against the influence of said biasing members. The tire deflating means can be remotely extended and retracted, which ensures that the user can be positioned in a location where they are not in physical danger.

30 Claims, 5 Drawing Sheets

PORTABLE ROAD BARRIER UNIT

FIELD OF THE INVENTION

The present invention relates to an apparatus and method of deploying a tyre deflation apparatus for selectively deflating one or more tyres of a vehicle.

BACKGROUND OF THE INVENTION

Various devices have been developed for utilisation by law enforcement and tactical security agencies for the purpose of halting fleeing vehicles or preventing a vehicle from trespassing in a secured zone.

Generally, products on the market include those that are fixed in position at a select location, such as a checkpoint, and activated by mechanical process, or a transportable device that requires manual deployment by a user.

The fixed devices require the target vehicle to pass a stationary device such as the checkpoint and can be avoided by using an alternate route.

On the other hand the transportable devices currently available pose significant risk to the user because the user must be positioned within the near vicinity of the fleeing vehicle, which may display unpredictable and erratic direction changes at high speed.

Currently available tyre deflation devices are either not portable or pose significant risk to the operator. There is therefore the need for an apparatus that overcomes at least some of the problems of currently available devices.

It should be appreciated that any discussion of the prior art throughout the specification is included solely for the purpose of providing a context for the present invention and should in no way be considered as an admission that such prior art was widely known or formed part of the common general knowledge in the field as it existed before the priority date of the application.

SUMMARY OF THE INVENTION

In a first aspect of the invention but not necessarily the broadest or only aspect, there is proposed an apparatus for deflating at least one tyre of a vehicle including, a multipantographic extendible tyre deflating means attached to a housing, a plurality of biasing members adapted to urge the tyre deflating means into an extended position, and a retraction means for withdrawing the tyre deflating means into a retracted position within said housing, wherein in said retracted position the tyre deflating means is held in place against the influence of said biasing members.

The tyre deflating means may include a series of support arms and base members. One end of the tyre deflating means can be hingedly attached to the housing, so that the opposing free end can be propelled out from within the housing to a selected distance. The tyre deflating means may further include a plurality of detachable tyre deflating elements. The tyre deflating elements are attached to the support arms by way of frangible cups.

The support arms and base members may be arranged in pantographic or scissor action arrangement. In preference the support arms and base members are in the form of a flattened bar constructed from PVC or a similar type of semi-rigid material.

In one form each support arm is connected to three base members, wherein a first terminal end of the support arm is pivotably connected to a first base member; a midpoint of the support arm is pivotably connected to a second base member; and a second terminal of the support arm is pivotably connected to a third base member. Adjacent support arms are attached to first and second, or second and third base members respectively. Since each support arm is pivotably connected to adjacent base members the tyre deflating means, in a folded arrangement, can be retained within the housing in a loaded arrangement against the influence of the biased member.

The connection between the support arms and base members can be achieved by way of a nut and bolt assembly or screws. Alternatively the connection may be achieved either by way of a moulded element that includes male and female members able to cooperate with an interference fit or a hinge member could be used.

In a further alternate form, spacer plates are located between the terminal ends of each support arm and respective first and third base members. The support arm and respective first and third base members are pivotably connected to the spacer plate.

In one form a biasing member extends between opposing terminal ends of adjacent support arms. In preference the biasing members are positioned perpendicular to the movement of the tyre deflating means. In an alternate form the biasing member extend between opposing spacer plates.

The spacer plates may include support arm and base member engagement means, such as slots, and a connection means for a terminal end of the biasing member. The spacer plate is preferably constructed from PVC or similar type material. The spacer plate may be moulded and have a height of between 10-20 mm.

In one form the biasing member includes springs that extend between opposing spacer plates. The springs may be retained within a non-deformable telescopic sheath. The telescopic sheath protects the spring when a tyre of a vehicle comes into contact with the apparatus.

In an alternate form the biasing members are elastomeric straps, which may extend between opposing spacer plates.

In a further form the biasing members are rubber blocks or discs that are held under torsion at the intersections of at least some of the support arms and base members.

In yet a further form the biasing members are elastic blocks positioned between adjoining support arms and base members. When the multipantographic tyre deflating means is in a retracted position the elastomeric blocks are compressed such that they tend to compel the tyre deflating means into an extended position.

The apparatus may include a winch connected to the cable for retraction of the tyre deflating means. One end of the cable is attached to the spool of the winch and the other terminal end is attached to a free end of the tyre deflating means.

The apparatus may further include a battery pack for operation of the winch. Alternatively the apparatus may include a motor or be hard wired to an external power source, such as mains power or a car battery.

In one form the retraction means is adapted to retain the tyre deflating means within the housing against the influence of said biasing members.

In another form the apparatus includes a retention means for retaining the tyre deflating means within the housing. The retention means may include a clip that secures the tyre deflating means. The clip may selectively engage the free end of the tyre deflating means. Alternatively the retention means may comprise a hinged door.

The apparatus may include a means for selective deployment and retraction of the tyre deflating means from a location removed from said apparatus. For instance the apparatus may include a RF receiver for receiving a signal from a remote control unit. The remote can be used to release the tyre deflating means such that it is deployed under the influence of the springs. The remote control unit can also be used to activate the winch to retract the cable thereby retracting the tyre deflating means into the housing. The housing may also include switches for selective deployment and retraction of the tyre deflating means. Furthermore, if the apparatus is located in a fixed position, the deployment and retraction of the tyre deflating means may be undertaken using a control panel that is hard wired to the apparatus.

In one form the apparatus further includes a range-determining device that is used to select the distance to which the free end of the tyre deflating means is extended. This may be particularly useful when the apparatus is being used under different conditions, such as different road configurations. For instance if the tyre deflating means is being deployed across a dual lane highway the distance to which the support arms are required to travel is greater than when the system is being deployed across a single carriageway. There may also be other physical objects that need to be avoided such as other parked vehicles or fixed road barriers.

The range-determining device may be a flange that physically prevents the base member and support arm, which are hingedly attached to the housing, from pivoting beyond a selected angle. In preference, a plurality of angles can be selected for different distances.

In another form the range-determining device controls the number of rotations of the winch, which therefore determines the range to which the tyre deflating means is extended.

The apparatus may also include guides for assisting the base members in traversing the ground surface. In one form the guides include skid plates to assist the tyre deflating means in being able to smoothly ride over the surface of the ground without being snagged on irregularities on the surface, such as manhole covers or potholes. In another form the guides include roller means attached to the bottom of the base member or spacer plates.

Preferably the tyre deflating elements are upwardly projecting spikes that include an elongated body, a tapered tip and a longitudinal extending groove. Alternatively, the elongated body may include an axial bore in fluid communication with at least one aperture adjacent said tapered tip. The spikes are adapted to break off once they have penetrated the tyre.

The tapered tip ensures that the spike is able to penetrate the wall of the tyre. Accordingly the spike is preferably constructed from a rigid non-deformable material such as metal. Once the spike has penetrated the tyre wall, the air within the tyre is able to escape in a controlled manner through the groove or aperture and adjoining axial bore.

The spike may further include at least one outwardly projecting annular barb to prevent dislodgement of the spike from the tyre. Accordingly in use the spike penetrates the wall of the tyre and the barb engages with the internal surface of the tyre wall. The spike is therefore held in place to ensure that the passageway for the escaping air is held open. The controlled release of air from within the tyre minimises the risk of a sudden release of air such as occurs in a tyre blow out, which can result in loss of vehicle control by the driver.

In one form the apparatus includes a balancer unit that stores energy in an internal spring such that when the tyre deflating means is deployed potential energy is stored in the spring to assist in retraction of the tyre deflating means.

In one form the winch, motor, receiver and other components are housed within a protective case to ensure they are not damaged if a vehicle were to come into contact with the case. The top of the protective case may be curved or have a peak to ensure that the case does not pose an obstacle to the wheel.

In a second aspect of the invention there is proposed a method for deflating at least one tyre of a target vehicle, including the steps of:

providing an apparatus having an extendible tyre deflating means attached to a housing, a plurality of biasing members adapted to urge the tyre deflating means into an extended position, and a retraction means for withdrawing the tyre deflating means into a retracted position within said housing, wherein, in said retracted position the tyre deflating means is held in place against the influence of said biasing members;

positioning said apparatus adjacent the expected route of said target vehicle; and activating said apparatus such that the tyre deflating means is propelled into said extended position to engage with at least one tyre of said target vehicle.

The method further including the step of activating the retraction means for withdrawal of the tyre deflating means into said retracted position within said housing. Preferably a winch and cable are used to retract the tyre deflating means.

The tyre deflating means preferably includes a plurality of support arms and base members that are pivotably connected in a pantographic or scissor-like configuration.

The apparatus may include tyre deflating spikes releasably attached to the support arms. The tyre deflating spikes may be attached using frangible cups.

In one form the apparatus is portable and able to be stored in the boot of a vehicle.

Preferably the apparatus includes a retention means for retaining the tyre deflating means in a retracted position when not in use.

In one form the apparatus includes a remote control unit and corresponding receiver for disabling the retention means to thereby allow the tyre deflating means to move into an extended configuration under the influence of said biasing members. The remote control unit and corresponding receiver may also be used to activate the winch to rewind the cable to thereby retract the tyre deflating means into the housing for transportation.

BRIEF DESCRIPTION OF THE DRAWINGS

The accompanying drawings, which are incorporated in and constitute a part of this specification, illustrate an implementation of the invention and, together with the description, serve to explain the advantages and principles of the invention. In the drawings.

DETAILED DESCRIPTION OF THE ILLUSTRATED AND EXEMPLIFIED EMBODIMENTS

Figure 1:
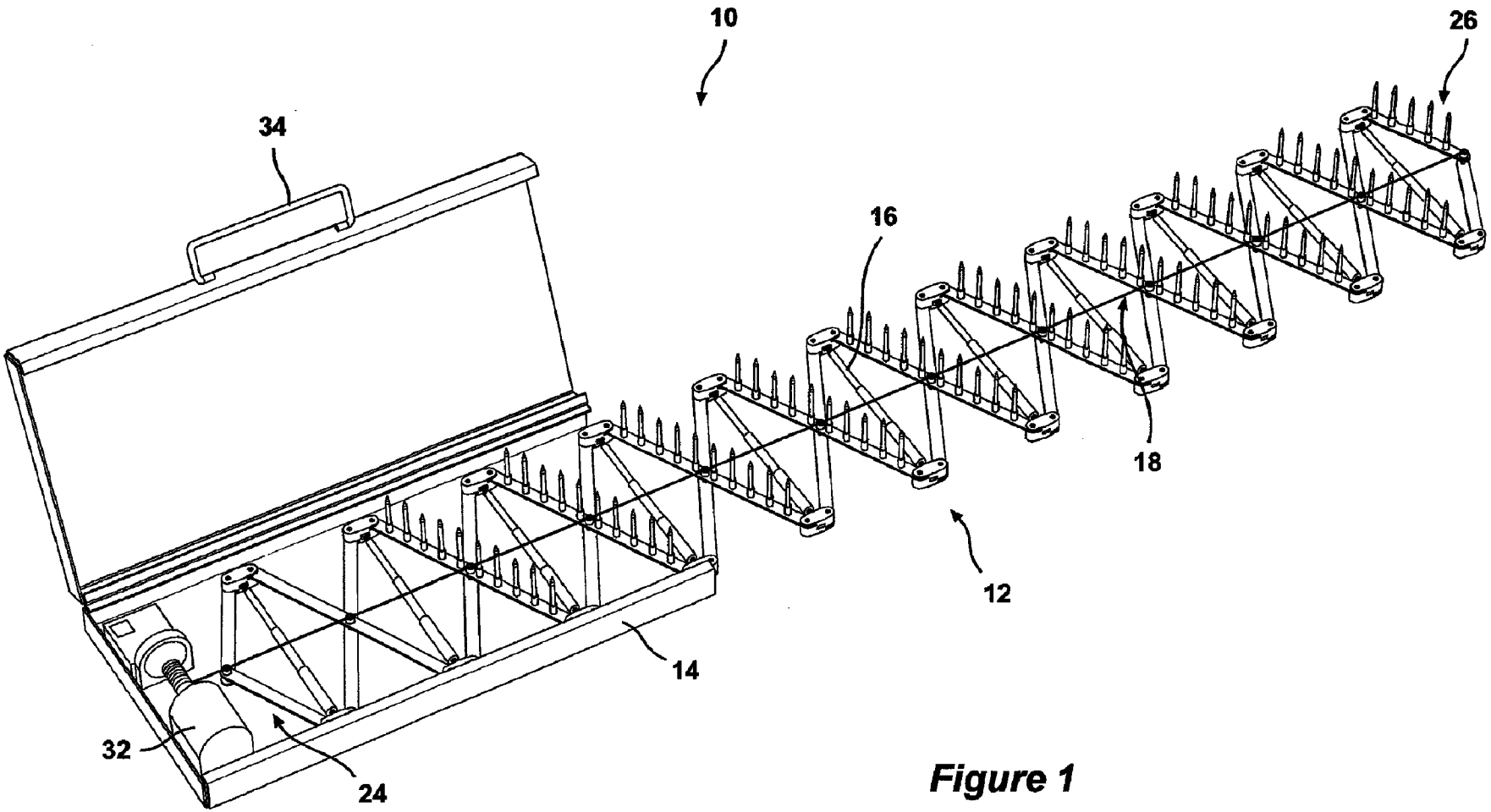
FIG. 1 is a perspective view of the tyre deflation apparatus of the present invention in an extended position.

Similar reference characters indicate corresponding parts throughout the drawings. Dimensions of certain parts shown in the drawings may have been modified and/or exaggerated for the purposes of clarity or illustration.

Referring to the drawings for a more detailed description, a tyre deflation apparatus 10 is illustrated, demonstrating by way of example an arrangement in which the principles of the present invention may be employed. The tyre deflation apparatus 10, as illustrated in the figures, includes a multipantographic extendible tyre deflating means 12 attached to a housing 14, a plurality of biasing members 16 adapted to urge the tyre deflating means 12 into an extended position, and a retraction means 18 for withdrawing the tyre deflating means 12 into a retracted position within the housing 14, wherein in the retracted position the tyre deflating means 12 is held in place against the influence of the biasing members 16.

Figure 2:
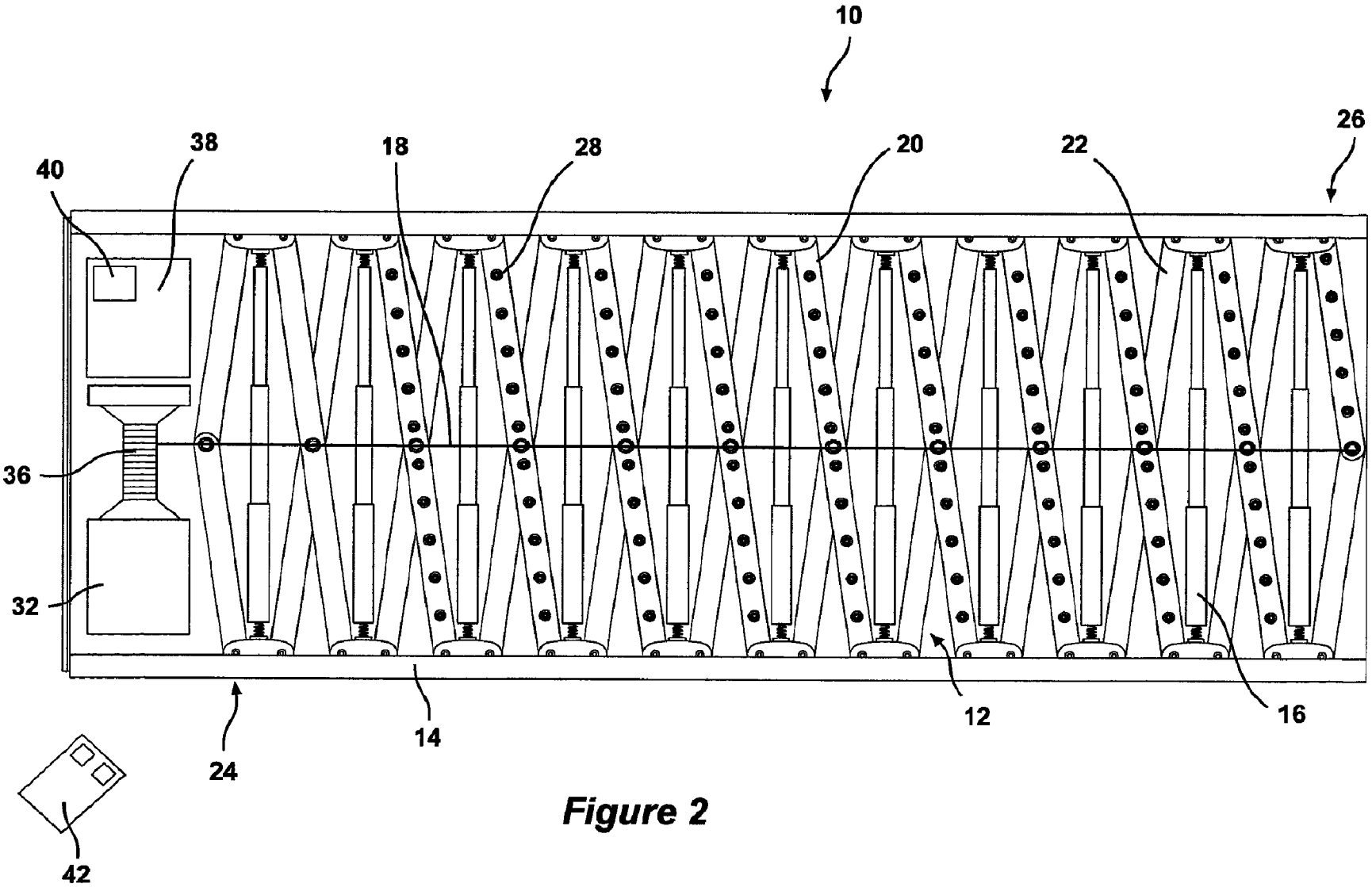
FIG. 2 is a top view of the tyre deflation apparatus of FIG. 1 in a retracted position.
Figure 5:
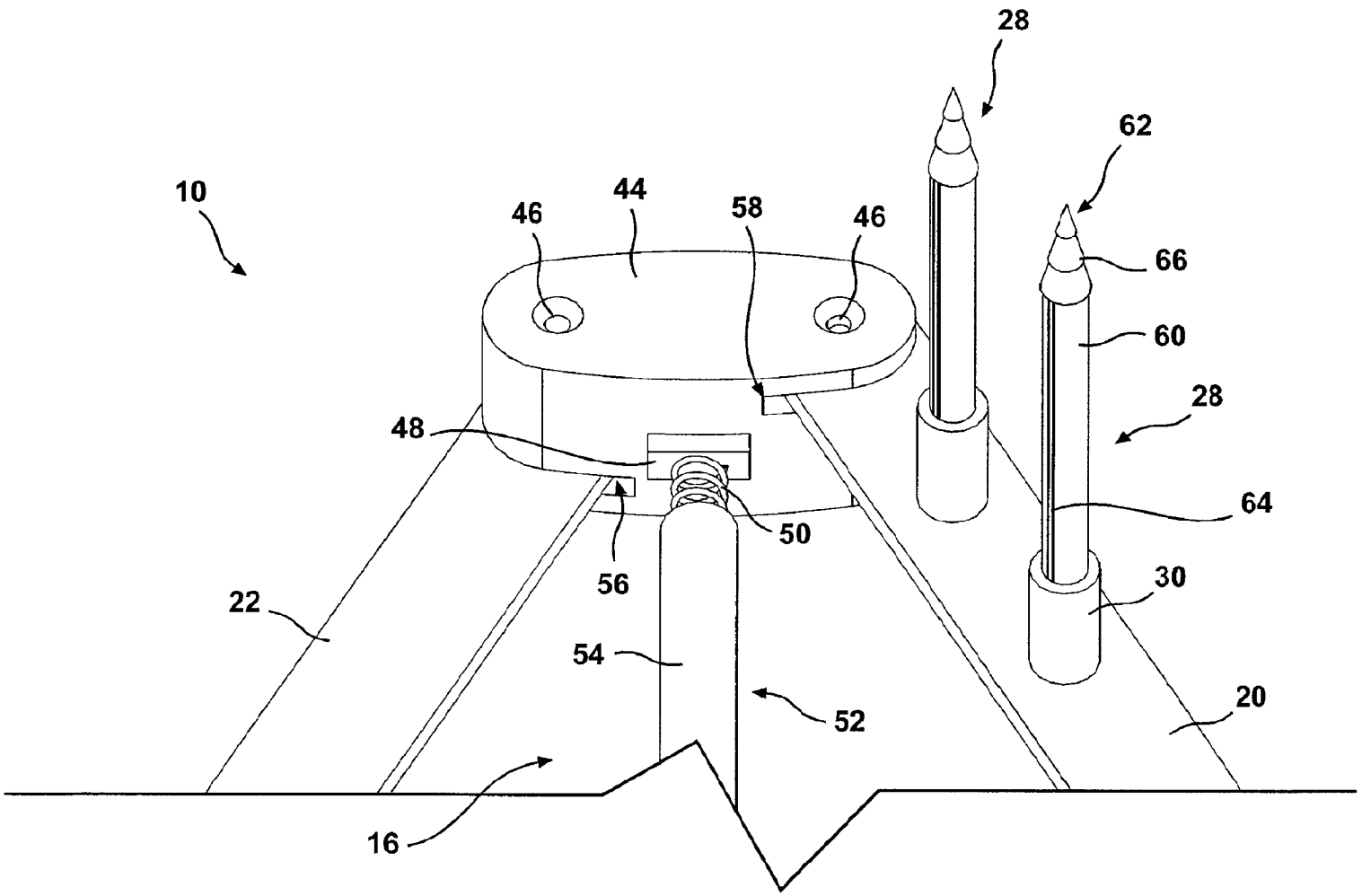
FIG. 5 is a side perspective view illustrating the spacer plate of FIG. 4.

In one embodiment, as illustrated in FIGS. 1 and 2, the tyre deflating means 12 includes a series of support arms 20 and base members 22. A first end 24 of the tyre deflating means 12 is hingedly attached to the housing 14 and the opposing free end 26 is configured to be propelled out from within the housing 14 into the extended position. The tyre deflating means 12 includes a plurality of detachable tyre deflating spikes 28 attached to the support arms 20 by way of frangible cups 30, as illustrated in FIG. 5. It should however be appreciated that other deflating means could be used.

In the present embodiment, as illustrated in FIG. 1, the retraction means 18, in the form of a cable, is attached to a winch 32. The housing 14 is a hinged case with handle 34, which facilitates ease of transportation. It should however be appreciated by the reader that the retraction means 18 and housing 14 are not limited to these particular embodiments.

It should be appreciate by the reader that the housing 14 illustrated in the figures is included as an example only and does not limit the scope of the invention. For instance the housing 14 may be in the form of an enclosed protective case that ensures the components housed therein are not damaged during use. The housing may be dome or prism shaped so that it does not pose an obstacle to a wheel of a vehicle if it comes into contact with the housing.

The support arms 20 and base members 22 are arranged in a pantographic or scissor-like arrangement. This ensures that they can be retracted into a folded configuration within the housing without the tyre deflating spikes creating an obstruction. The support arms and base members are constructed from PVC or a similar type of semi-rigid material so that they are not damaged when a vehicle passes over the extended device.

Each support arm 20 is connected to three base members 22, as illustrated in FIG. 2. The support arm 20 is pivotably connected to adjoining base members 22, at each terminal end and at the midpoint.

As further illustrated in FIG. 2, one end of the cable 18 is attached to the spool 36 of the winch 32 and the other terminal end is attached to a free end 26 of the tyre deflating means 12. The winch 32 and cable 18 can be used to retain the tyre deflating means 12 in a folded configuration within the housing against the influence of the biasing members 16. The winch 32 may include a clutch (not shown) for holding the tyre deflating means 12 in a folded configuration.

The apparatus 10 includes a battery 38 for operation of the winch 32. This ensures that the apparatus 10 is fully portable and can be set up in any desired location by the user.

The apparatus 10 further includes a receiver 40 and remote control unit 42 for selectively deploying and retracting the tyre deflating means 12. The use of the remote control unit 42 enables the apparatus 10 to be used by a person who is positioned in a location removed from the vicinity of the apparatus 10. The user can therefore position themselves at a safe distance from the apparatus 10 when the tyre deflation means 12 is being deployed or retracted. This ensures that the user is safe from any spikes that may become dislodged during use. It also means that the user is located at a distance from the target vehicle, which may alter course unexpectedly.

The remote control 42 is also used to activate the winch 32 to retract the tyre deflating means 12 into the housing 14 after the target vehicle has passed. This ensures that other vehicles are able to continue the pursuit without their path being obstructed. The apparatus 10 may also include override switches (not shown) on the housing 14 for deployment and retraction of the tyre deflating means.

Figure 3:
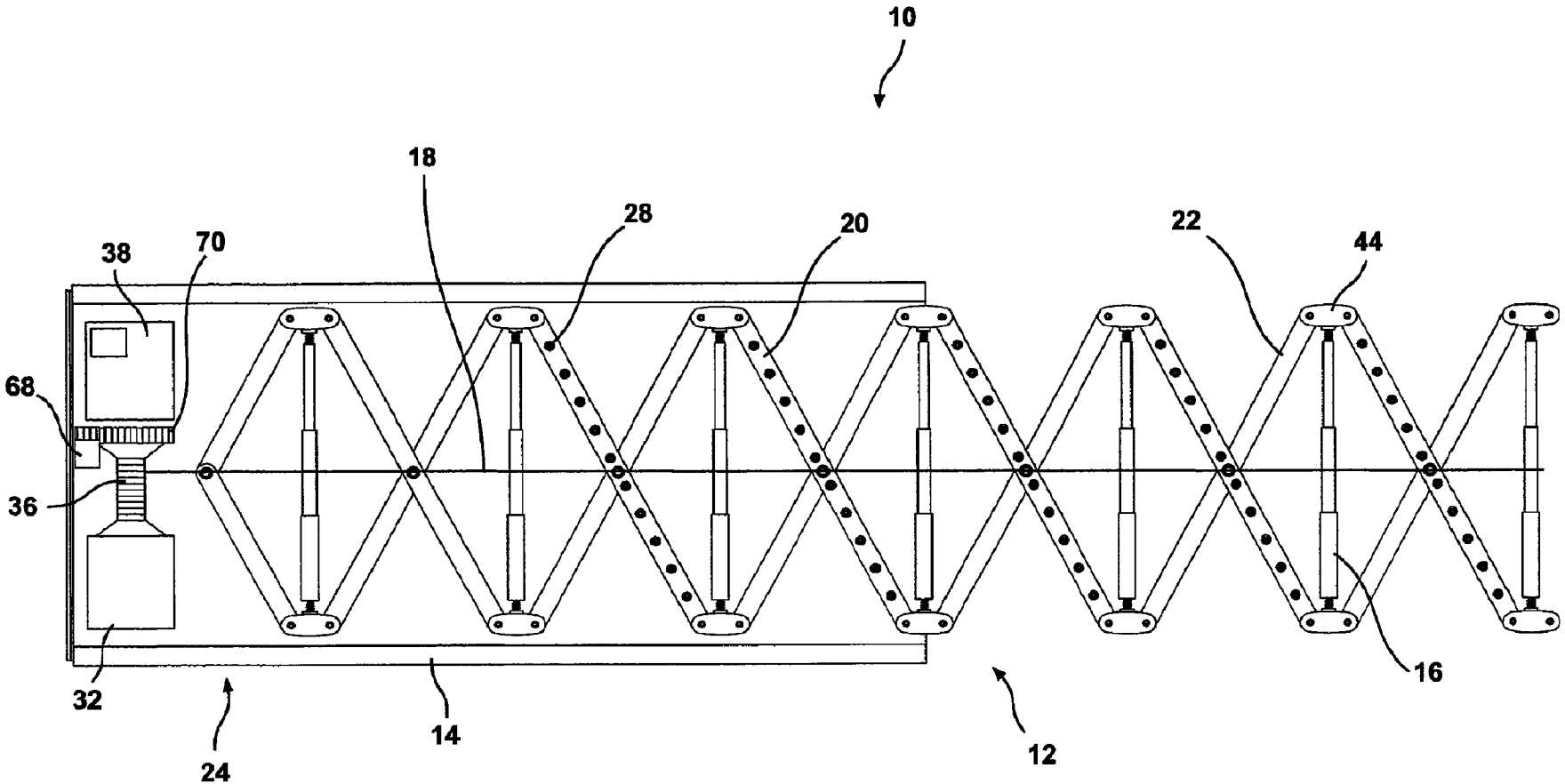
FIG. 3 is a top view of the tyre deflation apparatus of FIG. 1, illustrating the biasing means connected between opposing spacer plates.
Figure 4:
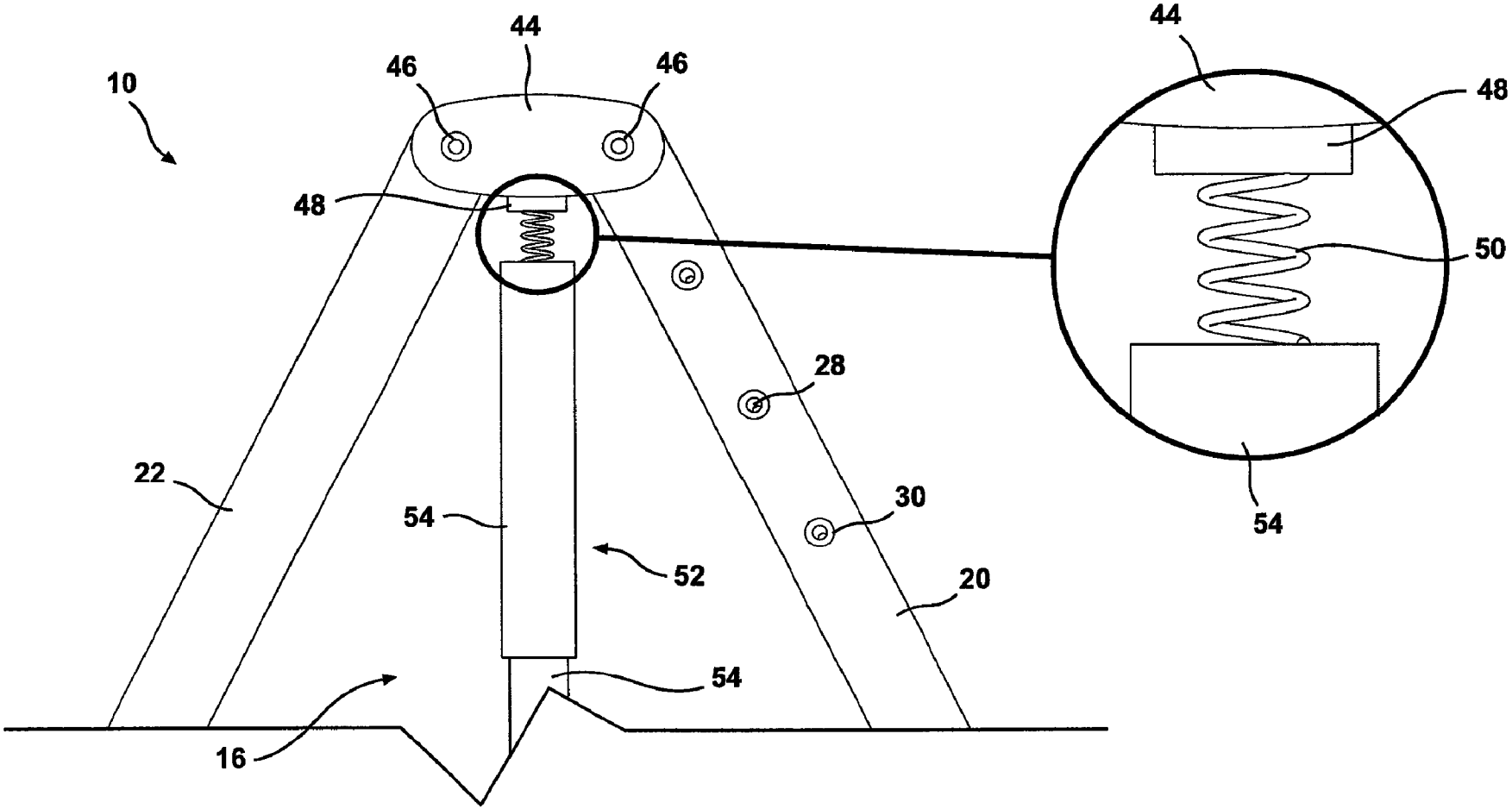
FIG. 4 is a top view illustrating the spacer plate of the tyre deflation apparatus of FIG. 1.

In one embodiment, as illustrated in FIGS. 3 to 5, spacer plates 44 are located between the terminal ends of the support arms 20 and base members 22. The support arms and base members are pivotably connected to the spacer plate 44 by way of a bolt 46 that engages with a threaded passageway in the attachment plate 44. It should however be appreciated that other types of connection means such as a pin or male/female members could be used as a connection means.

As further illustrated in FIG. 4, the spacer plate 44 includes a projection 48 to which the biasing member 16 is attached. In the present embodiment the biasing member 16 includes a spring 50 that is connected between opposing spacer plates 44. When the tyre deflating means 12 is in the folded configuration, the spring 50 is under tension and when the tyre deflating means 12 is in the extended configuration, the spring 50 is at rest. The spring 50 is enclosed within an extendible non-deformable sheath 52 that protects the spring 50 from the tyres of a vehicle as they pass over the apparatus. The sheath 52 includes a series of telescopic members 54 that slidably cooperate to form an extendable protective cover for the spring 50.

The spring 50 extends between projections 48 on opposing spacer plates 44, as illustrated in FIG. 3. In this way the biasing members 16 are positioned between adjacent support arms 20 and base members 22 when in a folded configuration.

The spacer plate 44, as illustrated in FIG. 5 includes slots 56 and 58 that are configured to engage a respective support arm 20 and base member 22, held in place by bolts 46. The bolt 46 that engages base member 22 is countersunk so that there are no projections on the underside of the spacer plate 44, since this could affect the deployment and retraction of the tyre deflating means 12.

The underside of the spacer plate 44 may further include a skid plate or guide (not shown) to assist in deployment of the apparatus to ensure that the tyre deflating means 12 can smoothly traverse the surface of the ground without being snagged on irregularities on the surface. The spacer plate 44 is typically constructed from moulded PVC or a similar type of material.

As further illustrated in FIG. 5, the slots 56 and 58 and the projections 48 are vertically displaced and may overlap. This means that in the folded position the tyre deflating means 12 takes up the least amount of room within the housing 14 while ensuring that there is no interference with the spring.

The tyre deflating spikes 28 include an elongated body 60, a tapered tip 62 and a longitudinally extending groove 64. The tapered tip 62 ensures that the spike 28 is able to penetrate the wall of a tyre. Accordingly the spike 28 is preferably constructed from a rigid non-deformable material such as metal.

Once the spike 28 has penetrated the tyre air is able to escape in a controlled manner through the longitudinally extending groove 64.

The spike 28 includes outwardly projecting annular barbs 66 that prevent dislodgement of the spike 28 from the tyre. Accordingly in use the spike 28 penetrates the wall of the tyre and the barbs engage with the internal surface of the tyre wall. The spike 28 is held in place to ensure that the passageway for the escaping air is held open, until the tyre is fully deflated.

The apparatus 10 includes a range-determining device 68, as illustrated in FIG. 3, able to terminate the distance to which the tyre deflating means 12 is extended. This may be particularly useful when the apparatus 10 is being used in various conditions, such as different road configurations. For instance if the tyre deflating means 12 is being deployed across a dual lane highway the distance to which it is required to travel is greater than when the system is being deployed across a single carriageway.

In the present embodiment the range-determining device 68 is a series of cogs 70 that determine the number of rotations of the spool 36 to thereby dictate the distance to which the tyre deflating means 12 is extended. The apparatus includes an adjustment device (not shown) for selecting the preferred distance to which the tyre deflating means 12 is extended. The reader should however appreciate that the range-determining device may be a flange that physically prevents the base members or support arms from pivoting beyond a selected angle.

The skilled addressee will now appreciate the many advantages of the illustrated invention. In one form the invention is able to provide a remote controlled tyre deflating apparatus that can be selectively positioned in the expected path of a vehicle in order to control movement of the target vehicle. The tyre deflating means can be selectively extended and retracted to ensnare a tyre of the target vehicle. Since the apparatus can be activated from a distance the user is not placed in a location that may be dangerous and place them at risk of flying debris or unexpected direction change of the target vehicle.

Various features of the invention have been particularly shown and described in connection with the exemplified embodiments of the invention, however, it must be understood that these particular arrangements merely illustrate, and that the invention is not limited thereto. Accordingly the invention can include various modifications, which fall within the spirit and scope of the invention. For the purpose of the specification the word "comprise" or "comprising" means "including but not limited to".

What is claimed is:

1. An apparatus for deflating at least one tire of a vehicle comprising:

a multipantographic extendible tire deflating means attached to a housing, a plurality of biasing members adapted to urge the tire deflating means into an extended position, a retraction means for withdrawing the tire deflating means into a retracted position within said housing, wherein in said retracted position the tire deflating means is being held in place against the influence of said biasing members, and wherein the biasing members extend between opposing spacer plates located on opposites sides of said tire deflating means.

2. The apparatus according to claim 1 wherein a first end of the tire deflating means is hingedly attached to the housing, and the opposing second end can be propelled out from within the housing.

3. The apparatus according to claim 1 wherein the tire deflating means includes a series of support arms and base members.

4. The apparatus according to claim 3 wherein the support arms and base members have a scissor-like action.

5. The apparatus according to claim 4 wherein the support arms and base members comprise a flattened bar constructed from a semi-rigid material.

6. The apparatus according to claim 5 wherein said spacer plates pivotably connects a support arm to a respective base member.

7. The apparatus according to claim 1 wherein the biasing member includes a spring.

8. The apparatus according to claim 7 wherein the spring is retained within a non-deformable telescopic sheath.

9. The apparatus according to claim 1 wherein the biasing members include elastomeric straps.

10. The apparatus according to claim 1 wherein the biasing members further include rubber blocks that are held under torsion.

11. The apparatus according to claim 10 wherein the rubber blocks are located at the intersections of at least some of the support arms and base members.

12. The apparatus according to claim 1 wherein the biasing members further include elastic blocks.

13. The apparatus according to claim 12 wherein the elastic block is positioned between an adjoining support arm and base member.

14. The apparatus according to claim 1 further including a winch connected to the cable for retraction of the tire deflating means.

15. The apparatus according to claim 14 wherein a first end of the cable is attached to a spool of the winch and the second end is attached to the second end of the tire deflating means.

16. The apparatus according to claim 1 further including a retention means for retaining the tire deflating means within the housing.

17. The apparatus according to claim 1 further including a receiver for receiving a signal from a remote control unit for operating said winch to deploy and retract the tire deflating means.

18. The apparatus according to claim 1 further including a range-determining device that is used to select the distance to which the tire deflating means is extended.

19. The apparatus according to claim 18 wherein the rotation of the spool can be controlled to limit the distance to which the tire deflating means is extended.

20. The apparatus according to claim 18 wherein a flange physically prevents the base member and/or support arm from pivoting beyond a selected angle to control the distance to which the tire deflating means is extended.

21. The apparatus according to claim 1 further including a guide for assisting the tire deflating means in traversing the ground.

22. The apparatus according to claim 21 wherein the guide includes a skid plate.

23. The apparatus according to claim 1 wherein said tire deflating means includes a plurality of detachable tire deflating elements.

24. The apparatus according to claim 23 wherein tire deflating elements are attached by way of a frangible cup.

25. The apparatus according to claim 24 wherein the tire deflating elements are an upwardly projecting spike that includes an elongate body, a tapered tip, at least one barb and a passageway for fluid communication between the internal space of the tire and the external environment once the spike has penetrated the wall of the tire.

26. A method for deflating at least one tire of a target vehicle, comprising the steps of:

providing an apparatus having a multipantographic extendible tire deflating means attached to a housing, a plurality of biasing members adapted to urge the tire deflating means into an extended position, a retraction means for withdrawing the tire deflating means into a retracted position within said housing, wherein in said retracted position the tire deflating means is held in place against the influence of said biasing members, and wherein the biasing members extend between opposing spacer plates located on opposites sides of said tire deflating means;

positioning said apparatus adjacent to the expected route of said target vehicle; and activating said apparatus such that the tire deflating means is propelled into an extended position to engage with at least one tire of said target vehicle.

27. The method according to claim 26 further including the steps of activating the retraction means for withdrawal of the tire deflating means into a retracted position within said housing.

28. The method according to claim 26 wherein a winch and cable are used to retract the tire deflating means.

29. The method according to claim 26 wherein tire deflating spikes are releasably attached to the tire deflating means.

30. The method according to claim 26 wherein a remote control and corresponding receiver are used to control movement of the tire deflating means.

* * * * *